US005118196A

United States Patent [19]

Ault et al.

[11] Patent Number: 5,118,196

[45] Date of Patent: Jun. 2, 1992

[54] ELECTROMAGNETIC CHRISTMAS TREE LIGHTS

[76] Inventors: David J. Ault, 2419 Maple Dr., Mobile, Ala. 36609; Thomas E. Atkins, 8911 Willow Hill Dr., Huntsville, Ala. 35802

[21] Appl. No.: 487,915

[22] Filed: Mar. 5, 1990

[51] Int. Cl.[5] ..... F21P 1/02

[52] U.S. Cl. ..... 362/123; 362/249; 362/251; 362/263; 315/76; 315/248

[58] Field of Search ..... 362/123, 249, 263, 251, 362/806; 315/34, 76, 248

[56] References Cited

U.S. PATENT DOCUMENTS

| | | | |
|---|---|---|---|
| 2,121,460 | 6/1938 | Waters | 362/123 |
| 2,181,889 | 12/1939 | Hanson | 362/263 |
| 2,268,870 | 1/1942 | Greenlee | 362/249 |
| 2,525,624 | 10/1950 | Stahl et al. | 362/123 |
| 3,614,528 | 10/1971 | Craddock | 362/123 |
| 4,039,894 | 8/1977 | Gardner, III | 315/34 |
| 4,622,495 | 11/1986 | Smeelen | 315/248 |

*Primary Examiner*—Ira S. Lazarus
*Assistant Examiner*—Sue Hagarman

[57] ABSTRACT

Wireless Christmas tree lights (1) illuminated by means of Electro-Magnetic Energy eminating from a self contained antenna. Multiple wireless lamps may be placed anywhere on the tree without being constrained by wire length. The Electro-Magnetic Energy is produced from an RF power unit (5) decorated like a gift box that may be placed under the tree or in a remote location several feet away. The various illumination effects are selected via a magnetic wand (8) that activates switches and selector circuits, and a non-linear modulator internal to the RF generator.

15 Claims, 6 Drawing Sheets

ELECTROMAGNETIC CHRISTMAS TREE LIGHTS

BACKGROUND

1. Field of Invention

This invention relates to lighting devices, specifically Christmas tree lights which illuminate due to the presence of an EMF (Electromagnetic Field). The lamps may be mounted in any position or on any location of the tree without the need of wires, antennas and electrodes, or the like connected to the lamps.

2. Description of Prior Art

Prior to this invention the illumination of Christmas tree lights by electromagnetic energy, such as the "Rabette Remote Lighting", U.S. Pat. No. 2,822,508, has relied on the use of vacuum tube devices, tuned tank coupling circuits, and most importantly, inefficient external antenna systems, located remotely from the tree.

An illumination system shown in the Pierce U.S. Pat. No. 3,411,003, also has problems propagating power to the illuminating devices. This method employed propagation perpendicular to the plane of the antenna system which could not be increased due to emission limits set by the F.C.C.

Electromagnetically Illuminated Christmas Tree lights prior to this invention could be improved upon in several ways. The first improvement pertains to the antenna location. A directional antenna that was unsightly and easily damaged, was located a moderate distance from the tree. The Electromagnetic Field (EMF) eminating from the antenna decreases in strength after traveling the distance to the tree. This was compensated for in two ways. The radio frequency (RF) generators were more powerful than the one in this invention would require. Unsightly antennas were attached to the lamps so that a maximum amount of RF power could be coupled to the electrodes inside the lamp.

Even with this additional apparatus, the EMF at the tree might not be optimum because of persons or objects that could be placed between the antenna and the tree, or non-uniform EMF at different locations on the tree. Any object placed between the source and the tree would interrupt the EMF causing the lights to extinguish.

People located between the source and the tree could be exposed to levels of RF radiation which are likely to be at hazardous levels.

The RF energy was created by means of vacuum tube devices and coupled to the antenna via a coupling coil in the tank circuit of the RF generator. This method of power coupling is the least desirable because changes in the load will cause the operating frequency to change.

OBJECTS AND ADVANTAGES

Accordingly, the following objects and advantages of the invention containing an antenna that is located inside or on the surface of the tree will be shown.

The most advantageous and unique difference in this invention is the location and phasing of the antenna. The antenna is within or on the surface of the tree structure and is constructed so that the RF field is concentrated between each pair of branches (antenna elements) thus concentrating the RF field around the gas filled lamps placed between branches which are then illuminated. The resulting EMF is a more intense EMF than would be produced by an external RF generator/antenna combination producing the same power output; consequently, the lamps do not need antennas or electrodes of any kind, and a lower powered RF generator can be used.

Another object of this invention are unique illumination effects that are easily selected by the user by means of the magnetic wand.

A further object is the ability to fabricate lamps with shapes and colors only limited by the inventors imagination due to the simple construction. Electrodes are not needed. The amount of heat produced is very low so that plastic type materials may be used.

Manufacturing ease and standardization is yet another object which is realized by providing a high Q series inductor to match the RF output stage of the RF generator to the antenna, thus changes in the load are well isolated from the output stage, minimizing changes to the operating frequency. This also permits easier matching of different size (larger or smaller trees) antennas since only the series inductor must be altered.

Additionally, highly efficient (50% to 70%) solid state devices such as transistors, OP-AMPs, and integrated circuits are used which permit very efficient operation, a compact manufactured article, and a nonlinear modulation waveform to better produce novel psedo-random illumination, blinking, and flickering effects from the lamps.

A final object of this invention is to comply with any government, and international regulations and accepted safety standards. The Electromagnetic Interference (EMI) is at or below the levels accepted by the U.S.A. and foreign governments. This is possible because the phased antenna system contains the EMF within the physical boundary of the tree. The operating frequency is in the VLF band and the EMF is well contained: the potential for hazardous radiation is nonexistent.

DRAWING FIGURES

Figure 1:
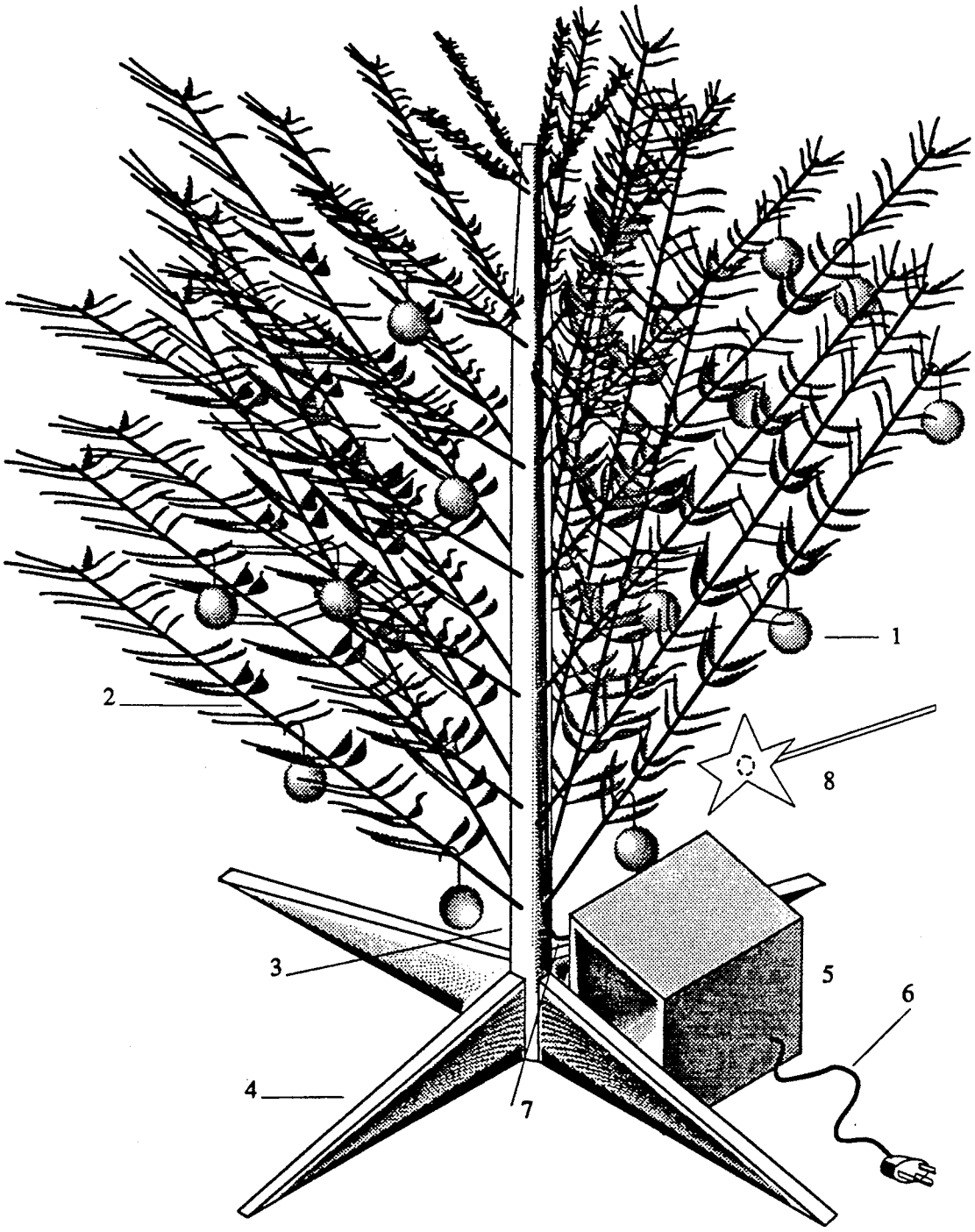
FIG. 1 is an isometric right front view of the invention without the optional ground screen.

DRAWING REFERENCE NUMERALS 1. gas filled lamp
2. tree branch
3. tree trunk
4. tree stand
5. RF power unit
6. 120 volt AC power cord
7. signal cable from RF generator.
8. ornamental magnetic wand
9. envelope.
10. gas.
11. coating.
12. magnetic latching power switch.
13. handle for wand.
14. magnet.
15. magnetic wand ornament.
16. odd antenna element.
17. even antenna element.
18. ornamental receptacle for illuminated tree top device.
19. output signal cable.
20. odd element distribution cable.
21. even element distribution cable.
22. RF grounding attachment.
23. orifice for output cable.
24. electrical connector for output cable.
25. orfice for ground connection cable.
26. ground screen.
27. multi color lamp shaped like candle.
28. candle flame.
29. candle body.
30. lamp shaped like ball.
31. lamp shaped like candy cane.
32. lamp shaped like star.
33. RF generator.
34. wire to radio frequency inductor.
35. RF inductor.
36. inductor core.
37. inductor windings.
38. output return wire.
39. RF power amplifier.
40. oscillator.
41. modulator.
42. DC power Supply.
43. AC Power Relay.

43A-43F. AC Power relay contacts.

44. internal power and control cable.
45. magnetic Switch.
46. control relay 46A-46B. control relay contacts 47. timer.
48. single element antenna.
49. RF generator common.
50. hanger.
51. tree trunk wall
52. electrical socket
53. twisted wire branch
54. twisted wire branch with hinge
55. hinge
56. wire
57. single element antenna
58. multiple element single phase
59. ground wire antenna
60. odd angular antenna element
61. even angular antenna element.
62. vertical antenna element.

MULTI-ELEMENT ANTENNA DESCRIPTION

An external view of the invention is shown in FIG. 1. The invention comprises a multiplicity of gas filled bulbs 1 in various ornamental shapes, multiple branches 2 which support the lamps and enclose the antenna (not shown in this figure), a tree trunk 3 to support the branches, a stand 4 to support the tree, an RF power unit 5 to produce the EMF (electric magnetic field), a power cord 6 to connect to the commercial power source, an output cable 7 for connecting the RF power unit to the antenna, and a magnetic wand 8 to activate the power switch 12.

FIG. 1 shows one of many embodiments of the lamp. The lamps may be suspended from the tree branches via hooks or similar fastening devices. The quantity of lamps that may be placed on the tree is only limited by space available on the tree limbs and the weight the tree structure can bear. The lamps are suspended from the tree branches by hooks or the like which are fastened to the lamp.

Figure 6:
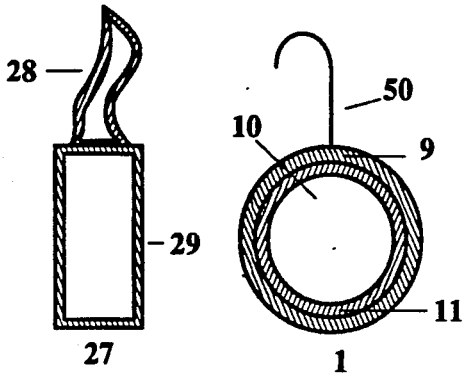
FIG. 6 is a section view of two typical lamp constructions.

The lamp 1 shown in FIG. 6 is similar to the typical flourescent or gas filled lamp commonly used in the home, industry, and commerce but with the following differences. No internal apparatus such as pins, heaters, electrodes and the like are needed for the bulb to illuminate. A detailed discussion of the lamp follows. The preferred construction of the lamp is a transparent vial 9 that has been evacuated and filled with one of the noble gases 10 such as neon, argon, and coated with a flourescent material on the inside surface 11 of the vial. The construction of the lamp is not critical, many variations from that stated above are possible. The material for the vial does not need to be glass since the amount of heat from the lamp is negligible. Any common transparent plastic material could be used for the vial. The common flourescent bulb such as model F4T5 with the connection pins, heaters, mercury vapor etc. will operate very well but contains constructional elements that are not necessary to promote illumination.

Figure 7:
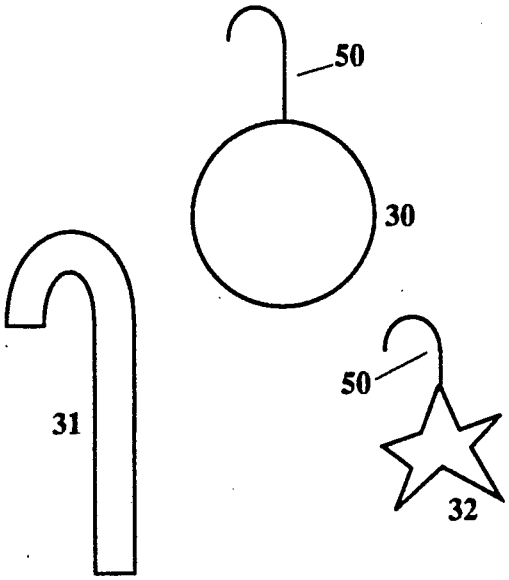
FIG. 7 shows several lamp shapes.

Additional embodiments of the lamp are shown in FIG. 6. Multiple sections can be shaped and and fastened together to form as many ornamental shapes as can be imagined. For example, traditional shapes like a candle 27 are possible by combining one section shaped like a flame 28 which has a yellow flourescent coating with another section shaped like the body of a candle 29 which has a white flourescent coating. Other shapes shown in FIG. 7, might be a ball 30, candy cane 31, star 32 etc. Since the lamps produce almost no heat, the lamps can be made from plastic materials which allows for many complex and imaginative shapes to be easily made.

Figure 2:
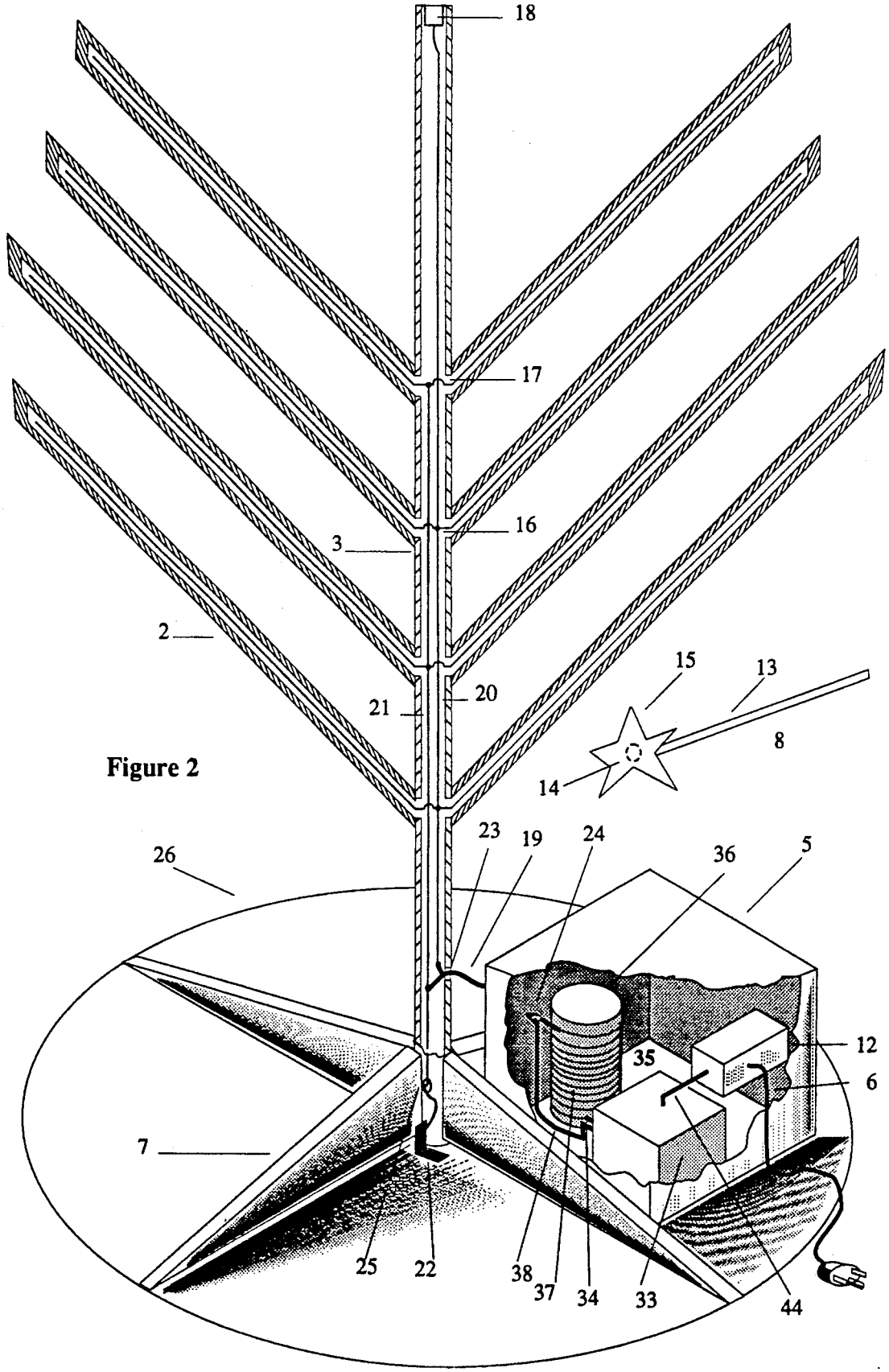
FIG. 2 is an isometric right front view of the invention showing the preferred antenna element embodiment.

The wand 8, shown in FIG. 2, used to operate the magnetic power switch 12, is comprised of a handle 13, a magnetic 14 and an ornament 15. The ornament, handle, and wand are made of any suitable non-magnetic material. The magnet and ornament are fastened to the handle 13 by a suitable means such as adhesive, screws or the like. The ornament that might be shaped like a star covers the magnet to enhance the attractiveness of the wand.

In the following constructional descriptions the actual construction of the tree is for reference. The main objective is to show methods of adding the multiple element antenna and RF power unit to both finished products and products being manufactured.

Figure 8:
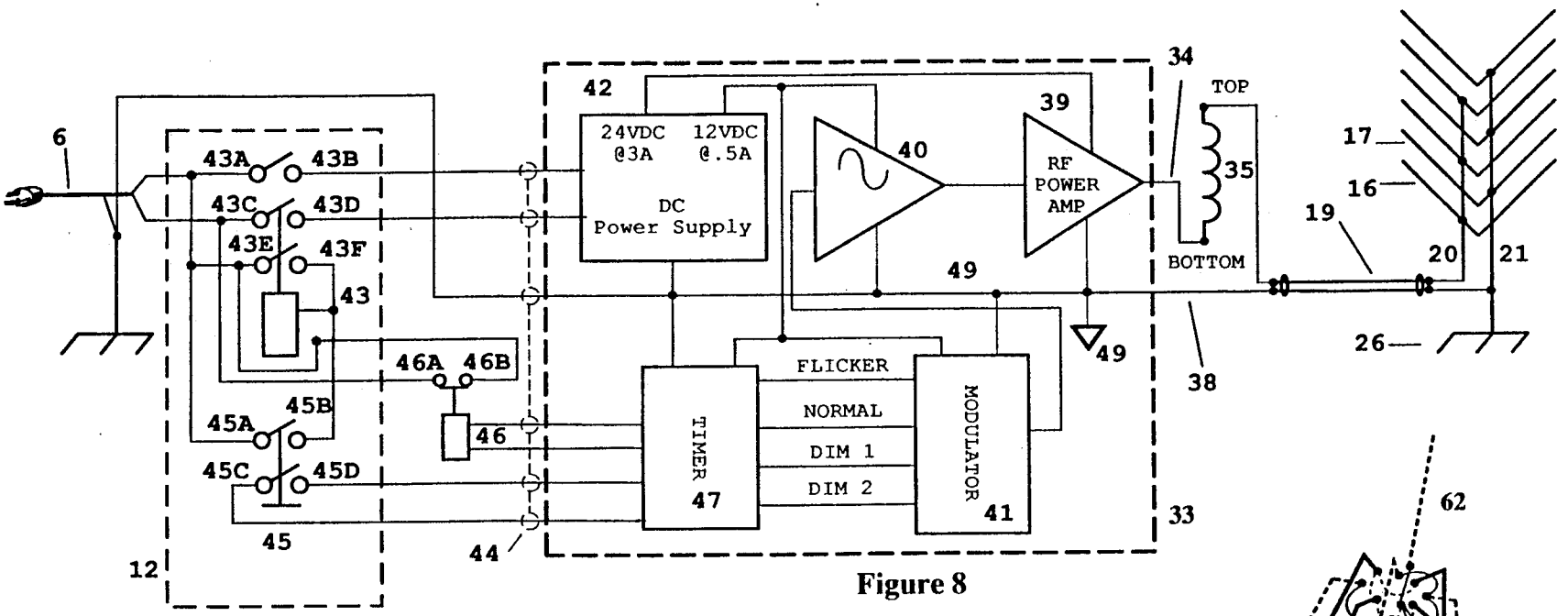
FIG. 8 is a schematic diagram of the internal components and the preferred antenna embodiment.

The preferred embodiment of the invention is shown in detail in FIGS. 2 and 8 whereby an internal antenna with a multiplicity of phased elements is used. Each odd 16 and even 17 antenna element is supported and/or enclosed by a tree branch 2. The antenna element may be constructed from any electrically conductive metallic material and is insulated from the other elements and user contact. A few of the many forms possible are described. Insulated wire was used in the prototype. The shape could be a rod such as uninsulated wire, metallic coated adhesive tape, or tubular such as a metallic film deposited on an insulator which might be the inside of the branch, etc.

A multiplicity of odd and even elements are spaced in a conically shaped array. The array is concentric about the tree trunk. Each element mates at an angle of approximately 15 to 60 degrees relative to the axis of the tree trunk. A greater number of elements in each array results in a more uniform field distribution and therefore even illumination. Six elements per array is the minimum number for good results with a tree six feet tall. The elements in each array are uniformly spaced, although, some variation in spacing will enhance the random flickering that is possible.

The spacing between odd and even element arrays should be between two and eight inches for a uniform field. The spacing on the prototype was six inches. The odd numbered elements 16 are connected to the odd element distribution cable 20. The even numbered elements 17 are connected to the even element distribution cable 21.

The lower end of the even element distribution cable 21 is simultaneously connected to the ground screen attachment 22 and the return wire in the output signal cable 19. The distribution cable 21 passes through the tree trunk 3 via the hole 25. The wires and cables are attached by soldering or wire fastening devices commonly available for this purpose. The ground screen attachment 22 is then connected to the ground screen 26 by soldering, electrical connection devices, screws, or the like. If less uniform illumination is acceptable from the lamps on the lowest branch then the ground screen may be removed and the earth is used as the reference. The ground screen 26 may be constructed of any metallic material, metallic coated material or a screen of metallic elements that is an approximately disk shaped and about 10 to 50 mils in thickness. The RF generator common 38 is connected to the earth via the "green ground" wire in the power cord 6.

The upper end of the odd element distribution cable 20 is connected to the "tree topper" socket 18. The lower end of the odd element distribution cable 20 is connected to the signal wire in the output signal cable 19. The output signal cable 19 passes through the tree trunk 3 via opening 23. The remaining end of the output cable is connected to the RF power unit via the connector 24. The connector is to facilitate convenient manufacturing, shipping, and user installation. This cable would normally be about one or two feet in length, although other lengths are possible.

Reference to both FIGS. 2 and 8 will clarify the discussion of the remainder of the invention. The RF power unit 5 is contained within an enclosure that is decorated to resemble a gift box. It would be constructed from a variety of common materials, metallic or non-metallic. If a metallic enclosure is used, all members of the enclosure should be securely bonded to each other and to the electrical utility ground system for proper operation and safety. The top winding of the RF inductor 35 is connected to the signal wire in the output cable 19 via one of the contacts in the connector 24. The bottom winding is connected to the output of the RF generator 33 via the wire 34. The RF inductor 35 is normally constructed as an air core inductor with a single layer winding 37 so that maximum "Q" is obtained. The approximate size of the inductor in the prototype is a cylinder 6 inches long by 4 inches in diameter. The inductance, $L_S$, is 2.9 milli-Henrys measured at 100 Hz. The actual size and inductance would depend on the operating frequency and capacitance of the antenna. One skilled in the art could decide on the required value, physical size, winding method, core materials, etc. The size of the inductor could be reduced considerably by using a suitable ferrite core form instead of an air core form 36; however, the efficiency would be reduced slightly. The other contact in the connector 24 is connected to the RF generator common via wire 38.

The RF amplifier 39 is connected to the oscillator 40 which may be modulated by the non-linear modulator 41. The power amplifier 39, oscillator 40, and modulator 41 are supplied power from the DC power supply 42. A wide variety of power supply types are possible. The best choice could be made by one skilled in the art. The power supply in the prototype was of standard construction utilizing a transformer, rectifier and filter capacitors and voltage regulator. The RF generator common 49 and all metallic components are connected to ground by means of the "green" ground wire in the AC power cord 6. The 120 VAC commercial power system is connected to the relay contacts 43A and 43C within the power switch 12 via the power cord 6, the relay contacts 43B and 43D are then connected to the power supply 42 by the internal power and control cord 44. Note that the relay shown could also be one of several solid state devices available for this purpose. The switch 45 is actuated by the magnet 14 which is part of the wand 8.

Figure 3:
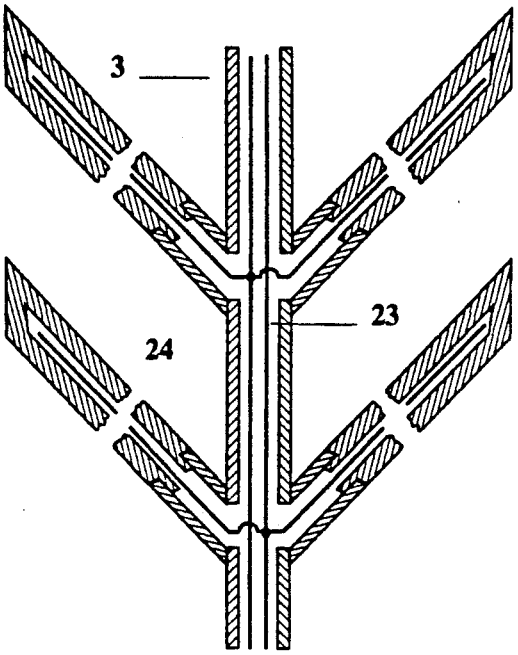
FIG. 3 is a section view of the electrical connections and mechanical placement for a typical set of antenna elements.

FIG. 3 is a detailed section view showing the multiple element antenna comprised of odd elements 16 and even elements 17 enclosed by a typical artificial tree branch. The internal antenna is supported mechanically by the tree branch; however, the elements may be additionally secured by a small bead of adhesive, pieces of tape, etc to prevent movement. The element are connected to the respective distribution cable by any of the normal methods of joining electrical conductors such as, soldering, crimped splices, insulation displacement connectors or mechanical fasteners. A typical configuration whereby the tree branches are placed in tubular receptacles in the trunk is shown; however, it is not the only method available.

Figure 4:
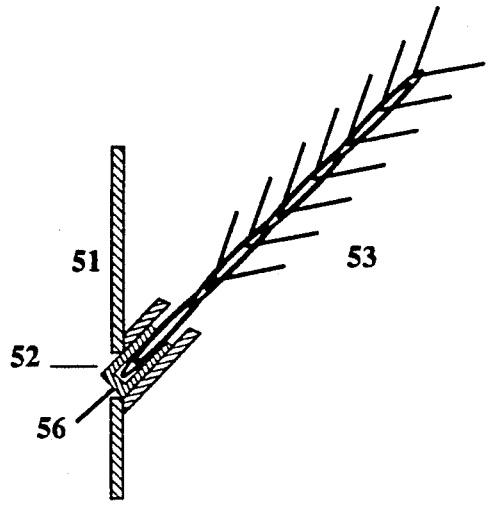
FIG. 4 shows an insulated twisted wire branch attachment detail.

In many instances, refer to FIG. 4, the branch 53 is simply a plastic coated twisted wire with embedded artificial leaves. A portion of the wire is uninsulated on the end that is inserted into the socket 52 for electrical contact. In this case the socket 52 in the tree trunk 51 would be connected to the appropriate distribution cable via wire 56 and the plastic coated twisted wire would become both the mechanical branch as well as the antenna.

Figure 5:
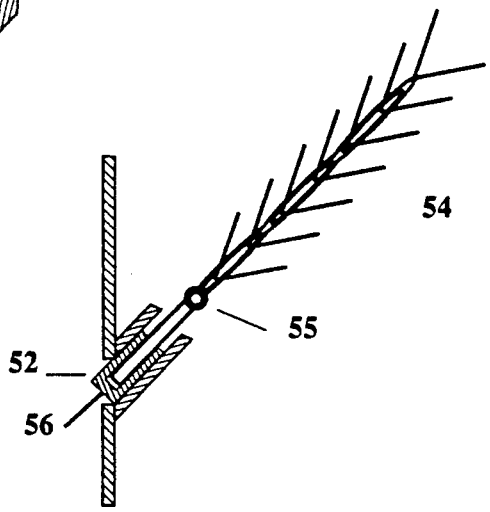
FIG. 5 shows the attachment detail for an insulated twisted wire branch with a hinge.

A variation of the wire branch 53 is shown in FIG. 5, the branch 53 has a hinge 55 added resulting in a hinged branch 54. The hinge is electrically conductive but insulated from the user.

Figure 12:
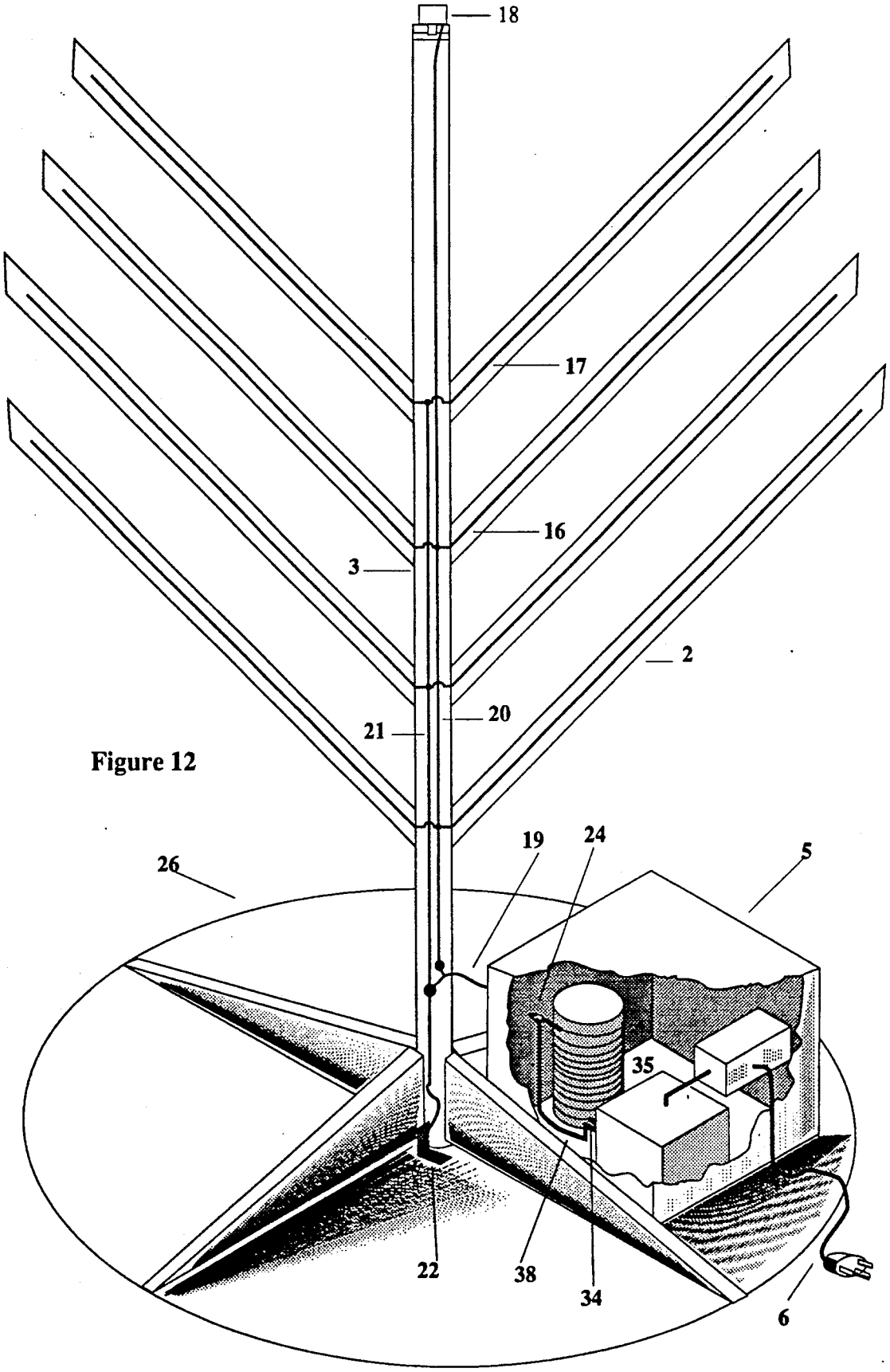
FIG. 12 is an isometric right front view of the invention showing the first alternate antenna element configuration.

FIG. 12 shows the antenna installed on the exterior surface of the tree. The ornamental receptacle 18, used to hold an illuminated tree top ornament, is fastened to the tree trunk 3 via a clamp, adhesive, screws or the like. The antenna elements and distribution cables are fastened to the exterior of the tree with fasteners commonly used for securing wire to structures such as tape, adhesive, mechanical wire ties, etc. The antenna comprised of odd elements 16 and even elements 17, is connected to the even 21 and odd 20 distribution cables.

The upper end of the odd distribution cable 20 is connected to the "tree topper" receptacle 18. The lower end of the odd distribution cable 20 is connected to the signal wire in the output cable 19. The even distribution cable 21 is further connected to the grounding attachment 22 and thereby the grounding screen 26 if used. The grounding attachment methods are the same as previously described. The antenna element is constructed of any type of metallic material shaped like a rod such as an insulated wire, uninsulated wire, adhesive coated tape, metallic film, strip of foil etc. The components of the RF generator and magnetic wand are the same as in FIG. 2.

Figure 13:
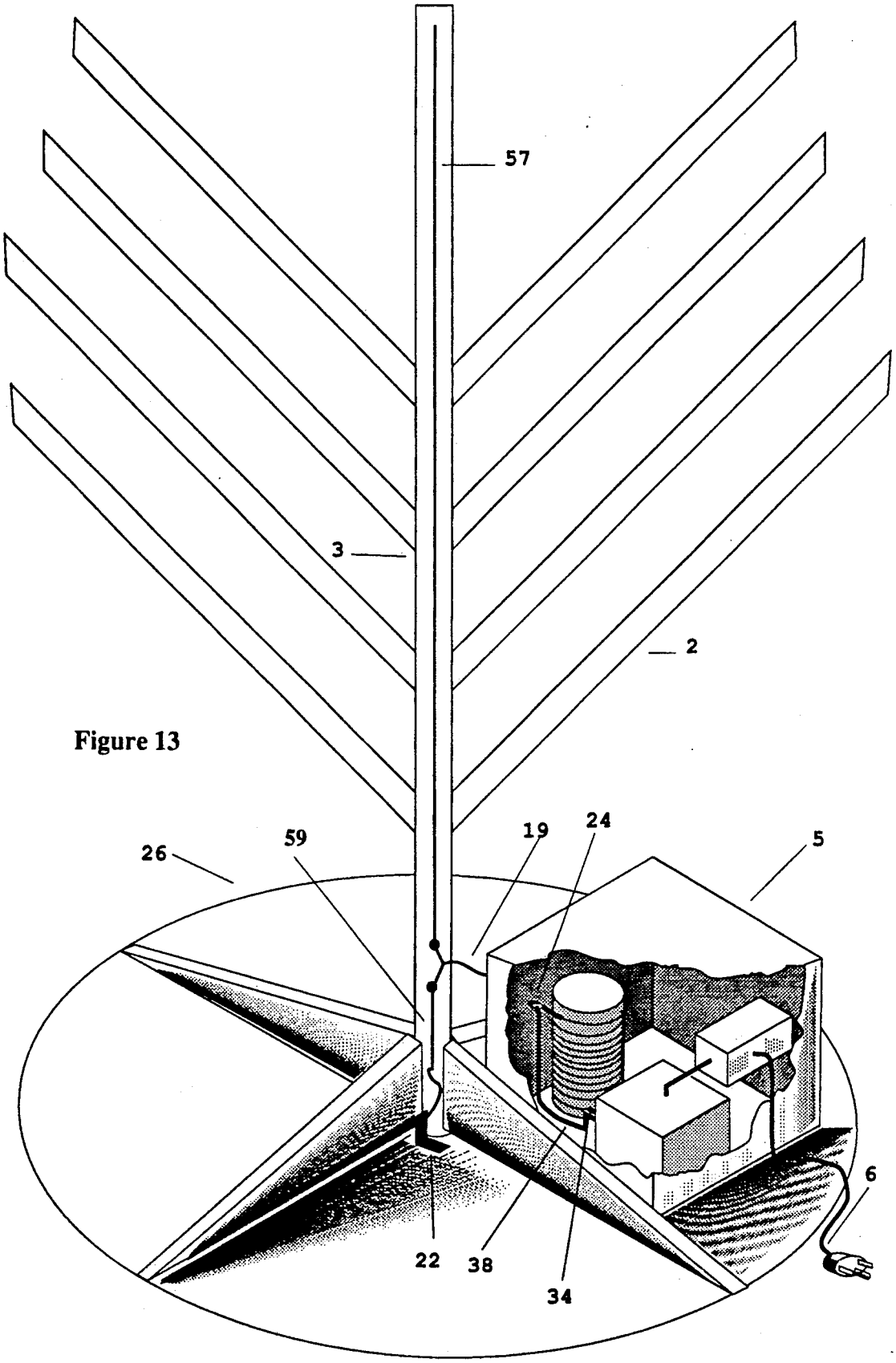
FIG. 13 is an isometric right front view of the invention showing the second alternate antenna element configuration.

The single element antenna embodiment is shown in FIG. 13. This is the least preferred antenna configuration because a uniform field is not possible; however, it is still superior to an external antenna placed remotely from the tree. The single element 46 is attached to the tree trunk 3 either internally or externally using any standard method for attaching wires. The element 46 is connected to the RF power unit 5 via the signal wire in the output cable 19. The antenna element is constructed of any type of metallic material shaped like a rod such as an insulated wire, uninsulated wire, adhesive coated tape, metallic film, strip of foil etc.

Figure 10:
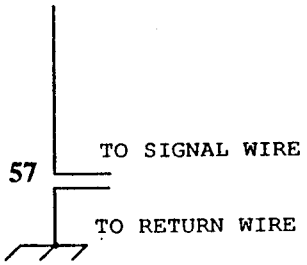
FIG. 10 is a schematic of the second alternate antenna elements.
Figure 9:
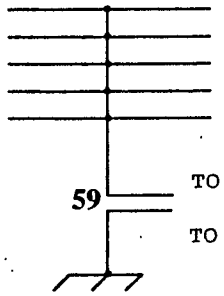
FIG. 9 is a schematic of the first alternate antenna elements.

The even element does not exist physically but is an electrical image by means of the ground plane 26 which is connected to the RF generator via the ground attachment 22, even distribution cable 21, and the return wire in the output cable 19, The schematic representations for the alternate embodiment single element antennas are shown in FIGS. 9 and 10. It can be seen that this embodyment can be a single wire or an array of wires connected to a single junction.

MULTI-ELEMENT ANTENNA OPERATION

The operation of all embodiments of the invention are the same, the prefered multi-element configuration will be described, Several modes of operation are possible; normal, flicker, dim, and off. The normal mode will be assumed.

The magnetic power switch 12 is activated when the user places the magnet 14 on the wand 13 adjacent to the side of the RF power unit 5 in close proximity of the magnetic swich 45 closing contacts 45A, 45B which activates the relay 43. Once the relay 43 is activated, contacts 43E and 43F close applying power to the relay in parallel with the switch contacts 45A and 45B, thus latching the relay in the "on" position. Contacts 43A, 43B, 43C, and 43D are also closed applying 120 VAC, 60 Hz, commercial power to the power supply 42 via the power cord 6 and internal power and control cable 44. The DC power supply 42 which is part of the RF power unit 5 converts the 120 VAC into unregulated 24 VDC at 3 Amps for the RF amplifier 39, and regulated 12VDC at 0.5 Amps for the oscillator 40, modulator 41, and timer 41. The relay 43 will remain actuated until the appropriate timer output energizes relay 46 opening contacts 46A, 46B thus de-energizing relay 43. Note that solid state devices could be used in place of the relays. The control relay 46 could also be part of the timer 47.

The timer was advanced to the first sequence which is normal illumination, since the switch 45 was activated for about three seconds closing contacts 45C, 45D,. The unmodulated oscillator 40 output is applied to the RF power amplifier 39 which delivers about 100 W of RF power to an approximately 50 ohm load. The output impedance of the RF amplifier and/or the load may be other values which would depend on the size of the tree, operating frequency, etc., as determined by a person skilled in the art. The output from the RF amplifier 39 is then applied via the output signal cable 19, RF inductor 35, odd element distribution cable 20 and even element distribution 21 cable to the various antenna elements. The odd antenna elements 16 are phased opposite from the even antenna elements 17 such that an EMF field is produced between each pair of even 17 and odd 16 antenna elements. The EMF field then ionizes the gas within the lamps 1 causing visible light to be emitted.

The novel special effects are selected by holding the wand 8 near the switch 45 for about three to four seconds. Each illumination effect is selected by holding the wand 8 for additional contiguous periods of about three to four seconds.

The timer 47 which is activated every time power is applied, will detect the presence of the wand then measure the amount of time the wand activates the switch 45. The desired modulation signal is then applied to the modulator 41.

The first timer position is normal bightness, thus no modulation is applied to the oscillator 40. The second timer position will select pseudo random flickering illumination effects which are caused by modulating the RF oscillator 40 with a ramp waveform a frequency of 0.1 Hz to 10 Hz. The third timer position will provide reduced intensity by modulating the RF oscillator between 0.1 Hz and 10 Hz with a non-uniform duty cycle sinusoidal or triangular waveform at a frequency between 30 Hz and 200 Hz. The resulting modulated waveform is applied to the RF power amplifier 39 and thus to the antenna.

A more detailed discussion of the timer operation will be described by referring to FIG. 8. Each time the contacts 45C, 45D are closed by presence of the wand 8, a sequential set of timed segments is started. Each segment could be approximately 3 seconds long. As each sequence is entered a different operating mode is selected such as normal illumination, flickering illumination, different levels of dim illumination, or power off by selectively placing only one of the timer outputs on. Each timer output enables a modulator circuit that creates the flicker, dim or other modulation signals of the like for the oscillator. Each modulation circuit is a unique set of circuit elements for the desired waveform. Several embodiments of the invention have been presented above. Examples have been given for variations in both construction and material usage. These are not the only methods and materials that may be used in constructing this invention. Those in the art can find many alternative construction methods and materials that are within the scope of the invention. Other antenna arrays of various shapes can be used as long as multiple sets of phased arrays are used.

Figure 11:
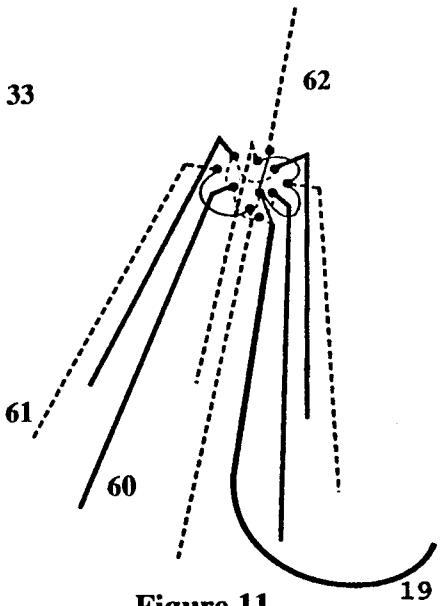
FIG. 11 is a diagrammatic view of the multiple element conical array antenna.

An example of this is shown diagrammatically in FIG. 11. An example of an artificial tree with the branches arranged as an inverted cone with the inside of the tree being hollow follows. The RF power is applied between the odd angular 60 and even angular 61 elements. Any additional vertical elements 62 would be connected to either the odd or uneven element. The vertical elements could also be similar to the embodiment shown in FIGS. 2, and 8.

Accordingly the reader is requested to determine scope of the invention by the claims which follow.

We claim:

1. An electromagnetic Christmas tree light comprising:

radio frequency oscillator means, receivable of a DC electric current and responsive to a modulation signal, for providing a modulated radio frequency current;

radio frequency modulator means, receivable of a DC electric current and operatively connected to said radio frequency oscillator, for producing a modulation signal, said radio frequency modulator means containing a plurality of selectively activatable modulation control circuits, each of said modulation control circuits producing a respective modulation control signal;

radio frequency amplifier means, receivable of a DC electric current and operatively connected to said radio frequency oscillator means, for producing an amplified modulated radio frequency current;

antenna means, receivable of an amplified modulated radio frequency current, for propagating an electromagnetic field, said antenna means comprising at least one array, said array comprising odd elements and even elements, said array including means for alternating polarity of said odd elements and said even elements, to propagate said electromagnetic field between said odd elements and said even elements, said antenna means further comprising distribution means for distributing said amplified modulated radio frequency current to said at least one array such that juxtaposed arrays alternate in polarity and said electromagnetic field is substantially contained within said antenna;

coupling means, operatively connecting said radio frequency amplifier means and said antenna means, for maximizing power transfer from said radio frequency amplifier means to said antenna means;

power supply means, receivable of an AC electric current, for rectifying and converting a AC electric current into a DC electric current, said power supply means operatively connected to said radio frequency oscillator means, said radio frequency modulator means and said radio frequency amplifier means;

switching means for electrically connecting said power supply means with an external AC power source, said switching means comprising at least one magnetically-closeable, normally open switch, latching means for latching said switch into a closed position when said switch is magnetically closed and deactivation means for unlatching said switch when closed, said at least one magnetically-closeable, normally open switch being closeable upon positioning of a magnetic object proximate said at least one magnetically-closeable, normally open switch;

timing means, operatively connected to said radio frequency modulator means and said power supply means, for selectively activating one of said plurality of selectively activatable modulation control circuits, said timing means including sensing for detecting the amount of time a magnetic object is proximate said at least one magnetically-closeable, normally open switch, said timing means selecting said one of said plurality of selectively activatable modulation control circuits to be activated in response to the amount of time said magnetic object is proximate said at least one magnetically-closeable normally open switch.

2. A phased antenna for producing Electro-Magnetic Fields surrounding a Christmas tree to illuminate gas filled vials attached to said Christmas tree comprising:

a multiplicity of spaced, connical, coaxial antenna arrays, each said antenna array with means for electrically inter-connecting multiple elongated, electrically conductive, spaced elements, a source conductor within a distribution cable, electrically connected in combination to a first antenna array and each said antenna array alternating from said first antenna array, a return conductor within said distribution cable, electrically connected in combination to a second antenna array and each said antenna array alternating from said second antenna array, means for attaching said elements and said distribution cable to said Christmas tree, whereby an Electro-Magnetic Field is interposed between adjacent said coaxial antenna arrays in a plane approximately perpendicular to the antenna element, juxtaposed said Electro-Magnetic Fields are approximately 180 degrees out of phase, and maximum energy is contained within said antenna to maximize illumination of said gas filled vial.

3. The antenna of claim 2 wherein said elements are placed within the Christmas tree structure.

4. The antenna of claim 3 wherein said elements are attached to the Christmas tree structure by means of an adhesive.

5. The antenna of claim 4 wherein said elements attached by adhesive are thin wires.

6. The antenna of claim 5 wherein said elements are made of a thin strip of flexible material coated on one side with an adhesive and said strip is coated on the other side with a metallic film.

7. The antenna in claim 2 wherein said elements are placed adjacent to the exterior surface of the tree structure.

8. The antenna in claim 7 wherein said elements are attached to the Christmas tree structure by means of thin straps which encircle both said tree structure and said element.

9. The antenna of claim 2 wherein said elements are constructed of insulated ornamentally decorated twisted wire and conductive part of wire is attached to said structure by means of an electrical socket embedded within the Christmas tree structure wall.

10. The antenna of claim 9 wherein said twisted wire element is provided with a hinge whereby said Christmas tree may be easily stored.

11. A wireless Christmas tree light set comprising;

A) a plurality of electrodeless lamps, each of said lamps comprising a translucent envelope containing a gas and a predetermined quantity of mercury, said envelope having an interior coating of a fluorescent substance;

B) a power control circuit, connectable to an external 60 Hz electric power supply, comprising:

a multiple-throw multiple-pole power relay, latch means to latch said power relay in on state after said power relay is put in on state, a signal relay, receivable of a control signal, for unlatching said power relay upon receipt of a control signal, a normally open switch means for placing said power relay in on state when closed, said normally open switch means being closeable by placement of a magnet proximate said normally open switch means and generating a closure signal when closed;

C) a vertical antenna comprising:

a plurality of spaced coaxial arrays, each array having a plurality of electrically interconnected, elongated, spaced elements, means to attach said elements to a Christmas tree, said arrays divided into odd number arrays and even number arrays, said odd numbered arrays alternating with said even numbered arrays, a source conductor in a distribution cable electrically connected to each said odd numbered array, a return conductor in aid distribution cable connected to each said even numbered array;

D) a thin circular metallic plate, disposable at the base of said vertical antenna, said metallic place electrically connectable to said return conductor in said distribution cable;

E) a radio frequency power supply unit, electrically connected to said power control circuit and said vertical antenna, for supplying radio frequency power across said source conductor and said return conductor when said multiple-throw, multiple-pole power relay is in on state; and F) magnetic wand means for closing said normally open switch means, said wand means comprising:

a manually graspable handle, a magnet connected to said handle, and an ornamental covering for at least partially concealing said magnet;

said radio frequency power supply unit and said vertical antenna cooperating to produce an electromagnetic field substantially contained within said Christmas tree of sufficient intensity to cause said electrodeless lamps to illuminate when placed within said electromagnetic field.

12. The lamp in claim 11 with the addition of a second envelope with means of attachment to first said envelope, said second envelope is coated on the inside surface with a flourescent material with means for emitting a second colored visible light.

13. The wireless Christmas tree light set according to claim 11, wherein said radio frequency power supply unit compirses:

a high Q radio frequency inductor comprising a core and spaced winding wound on said core, said inductor being connectable to said source conductor being connectable to said source conductor of said distribution cable, a radio frequency power amplifier for supplying radio frequency power to said inductor, a radio frequency oscillator for supplying a radio frequency current to said amplifier;

a modulator for amplitude modulating said oscillator from a plurality of selectable non-linear variable duty cycle signals, a timer circuit means for selecting one of said plurality of selectable non-linear variable duty cycle signals for amplitude modulation of said oscillator in response to said closure signal and generating a control signal for said signal relay in a predetermined manner, a power supply, interconnecting said power control circuit and said amplifier, said oscillator, said modulator and said timer, for receiving 60 Hz AC current from said power control circuit and converting said AC current into DC current.

14. The wireless Christmas tree light set according to claim 13, wherein said core is a noninductive electrically insulating air core.

15. The wireless Christmas tree light set according to claim 13, wherein said core is a ferrite core.

* * * * *